US010081176B2

(12) United States Patent
Kato et al.

(10) Patent No.: US 10,081,176 B2
(45) Date of Patent: Sep. 25, 2018

(54) LIQUID DISCHARGING APPARATUS

(71) Applicant: SEIKO EPSON CORPORATION, Tokyo (JP)

(72) Inventors: Junya Kato, Matsumoto (JP); Yugo Ishikawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/606,785

(22) Filed: May 26, 2017

(65) Prior Publication Data

US 2017/0341373 A1 Nov. 30, 2017

(30) Foreign Application Priority Data

May 30, 2016 (JP) ..... 2016-107083

(51) Int. Cl.
*B41J 2/045* (2006.01)

(52) U.S. Cl.
CPC ..... *B41J 2/04505* (2013.01); *B41J 2/04586* (2013.01)

(58) Field of Classification Search
None
See application file for complete search history.

(56) References Cited

U.S. PATENT DOCUMENTS 5,541,626 A 7/1996 Hiramatsu et al.
9,744,786 B2 * 8/2017 Kato ..... B41J 29/393
2017/0028754 A1 2/2017 Kato et al.

FOREIGN PATENT DOCUMENTS

JP 05-301413 11/1993

OTHER PUBLICATIONS

Ip.com search.*

* cited by examiner

*Primary Examiner* — Lisa M Solomon
(74) *Attorney, Agent, or Firm* — Workman Nydegger

(57) ABSTRACT

A liquid discharging apparatus enhances a detection accuracy of a contact state when a recording medium and a liquid discharging unit come into contact, and suppresses contact between the recording medium and the liquid discharging unit, which may cause damage. The liquid discharging apparatus includes a transport unit, a liquid discharging unit, a skirt provided to the liquid discharging unit in a position that faces the recording medium transported to the recording region, a piezoelectric film sensor adhered to an adhering surface of the skirt and configured to generate an output in accordance with a degree of deformation of the adhering surface, and a control unit configured to control the liquid discharging unit and/or the transport unit on the basis of the output of the piezoelectric film sensor. The adhering surface of the skirt includes a slit formed around the periphery thereof.

13 Claims, 9 Drawing Sheets

LIQUID DISCHARGING APPARATUS

BACKGROUND

1. Technical Field

Embodiments of the present invention relate to a liquid discharging apparatus.

2. Related Art

In the related art, liquid discharging apparatuses configured to discharge a liquid such as ink onto a transported recording medium have been used. In such a liquid discharging apparatus, when the transported recording medium and a liquid discharging unit come into contact with each other, at least one of the recording medium and the liquid discharging unit may become damaged. Hence, to suppress contact between the recording medium and the liquid discharging unit, various techniques have been disclosed.

For example, JP-A-1993-301413 discloses a liquid discharging apparatus (inkjet recording apparatus) that suppresses contact between the recording medium and the liquid discharging unit (recording head) by detecting a transport error of the recording medium using an optical detection device.

Nevertheless, an optical detection device as disclosed in JP-A-1993-301413, or a mechanical type detection device of the related art, or the like may erroneously determine that the recording medium and the liquid discharging unit are in contact when they not in contact, or conversely that the recording medium and the liquid discharging unit are not in contact when, in fact, they are in contact with each other. The detection accuracy of the detection device of the related art that detects contact between the recording medium and the liquid discharging unit is thus low. With such a low detection accuracy, the problem arises that contact between the recording medium and the liquid discharging unit may cause damage to at least one of the recording medium and the liquid discharging unit.

SUMMARY

Embodiments of the invention have been made to solve at least part of the problems described above, and can be realized as the following modes or application examples.

Application Example 1

A liquid discharging apparatus according to the present application example includes a transport unit configured to transport a recording medium in a transport direction, a liquid discharging unit configured to discharge a liquid onto the recording medium transported to a recording region, a sensor adhering plate provided to or on the liquid discharging unit in a position that faces the recording medium transported to the recording region, a piezoelectric film sensor adhered to an adhering surface of the sensor adhering plate and configured to generate an output in accordance with a degree of deformation of the adhering surface, and a control unit configured to control the liquid discharging unit and/or the transport unit on the basis of the output of the piezoelectric film sensor. In one embodiment of the liquid discharging apparatus, the adhering surface of the sensor adhering plate includes a slit formed around a periphery thereof.

According to the application example, the slit (for example a fine groove that penetrates the sensor adhering plate) is formed around the periphery of the adhering surface onto which the piezoelectric film sensor is adhered. This arrangement makes the region of the sensor adhering plate that includes the adhering surface less susceptible to stress from the periphery when the adhering surface deforms (or is about to deform). That is, the slit is provided around the periphery of the adhering surface, making it possible to facilitate deformation of the adhering surface. Thus, the piezoelectric film sensor adhered to the adhering surface makes it possible to detect the recording medium that comes into contact with the region of the sensor adhering plate, which includes the adhering surface, with higher sensitivity. In one example, it is possible to detect when the recording medium comes into contact with the region of the sensor adhering plate with higher accuracy. This makes it possible to further enhance the detection accuracy of detecting the contact state when the recording medium and the liquid discharging unit come into contact each other. This also makes it possible to suppress contact between the recording medium and the liquid discharging unit that may cause damage to at least one of the recording medium and the liquid discharging unit.

Application Example 2

In this example, the liquid discharging apparatus according to the application example above is further configured such that the sensor adhering plate includes a deformation regulating unit that regulates a maximum amount of deformation of the adhering surface.

According to the present application example, the sensor adhering plate includes the deformation regulating unit that is configured to regulate the maximum amount of deformation of the adhering surface, thereby preventing the adhering surface, which is configured to easily deform, from deforming beyond a limit. That is, damage to the sensor adhering plate (the region of the sensor adhering plate that includes the adhering surface) caused by contact with the recording medium or the like is prevented.

Application Example 3

The liquid discharging apparatus according to the application examples above may be further configured such that the liquid discharging unit includes a recording head provided with a plurality of nozzles configured to discharge the liquid. The adhering surface is provided to or on a back surface of a recording medium facing surface of the sensor adhering plate. The recording medium facing surface faces the recording medium transported to the recording region. A space between the back surface of the adhering surface and the recording medium transported to the recording region is smaller than a space between the recording head and the recording medium transported to the recording region.

According to the present application example, a distance between the back surface of the adhering surface onto which the piezoelectric film sensor is adhered and the recording medium transported to the recording region is less than a distance between the recording head and the recording medium transported to the recording region. This makes is possible for the piezoelectric film sensor to detect that the recording medium is near but not in contact with the recording head. This makes it possible to suppress contact between the recording medium and the liquid discharging unit which contact causes damage to at least one of the recording medium and the liquid discharging unit.

Application Example 4

The liquid discharging apparatus according to the application examples above may be further configured such that the piezoelectric film sensor includes a detecting unit configured to generate an output in accordance with a degree of deformation of the adhering surface, and a circuit unit that includes a circuit configured to transmit the output to the control unit. In such a liquid discharging apparatus, the slit is formed around the periphery of the adhering surface onto which the detecting unit is adhered.

According to the present application example, the slit is provided around the periphery of the adhering surface onto which the detecting unit of the piezoelectric film sensor is adhered, making it possible to facilitate deformation of the adhering surface onto which the detecting unit is adhered. This makes it possible to further increase the sensitivity of the piezoelectric film sensor. Further, the slit is not formed around the periphery of the adhering surface onto which the circuit unit is adhered in one example, making it possible to decrease the degree to which the circuit unit deforms and thus suppress a decrease in reliability of the circuit unit.

Application Example 5

The liquid discharging apparatus according to the application examples above may be further configured such that the liquid discharging unit allows discharging of the liquid while moving in an intersecting direction that intersects with the transport direction. The control unit controls the movement of the liquid discharging unit on the basis of the output of the piezoelectric film sensor.

According to the present application example, it is possible to prevent contact between the recording medium and the liquid discharging unit that moves in the intersecting direction, which causes damage to at least one of the recording medium and the liquid discharging unit.

BRIEF DESCRIPTION OF THE DRAWINGS

Embodiments of the invention will be described with reference to the accompanying drawings, wherein like numbers reference like elements.

DESCRIPTION OF EMBODIMENTS

Hereinafter, exemplary embodiments will be described with reference to the accompanying drawings. The following discloses a recording apparatus according to an example that serves as "the liquid discharging apparatus" of the invention, without limiting embodiments of the invention. Note that, in each diagram below, elements may be illustrated on a scale that differs from actuality for ease of explanation. Further, "intersect" means "preferably intersect" unless otherwise stated.

Exemplary Embodiment 1

Figure 1:
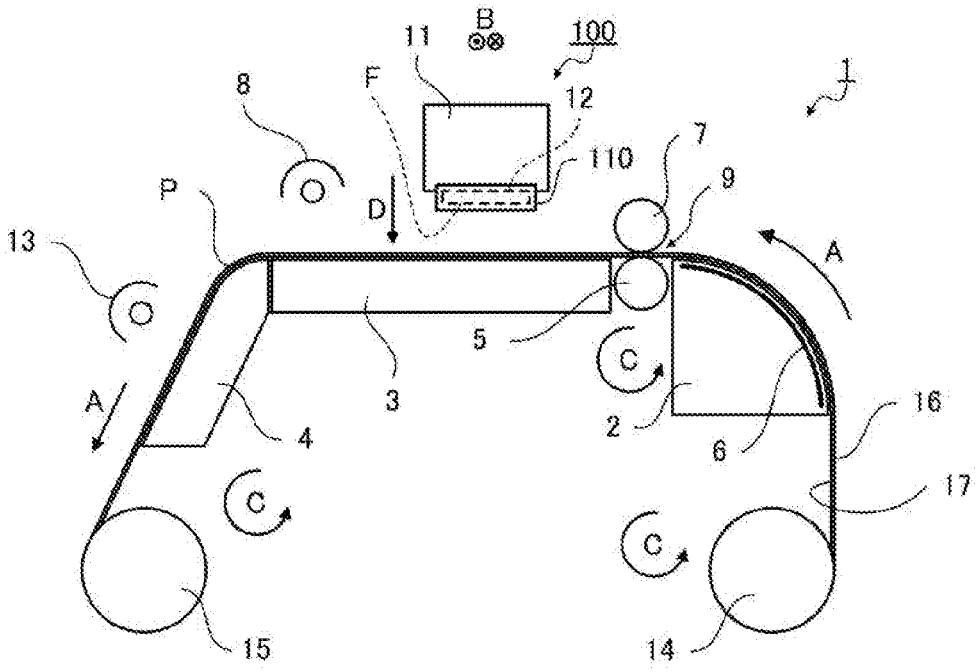
FIG. 1 is a schematic side view illustrating a recording apparatus according to Example 1 of the invention.

FIG. 1 is a schematic side view illustrating a recording apparatus 1 according to the present exemplary embodiment.

The recording apparatus 1 according to the exemplary embodiment includes a transport unit 9 configured to transport a recording medium P in a transport direction A, a liquid discharging unit 100 configured to discharge ink as a "liquid" onto the recording medium P transported to a recording region, a skirt 110 serving as a "sensor adhering plate" provided to or on the liquid discharging unit 100 in a position that faces the recording medium P transported to the recording region, a piezoelectric film sensor 120 adhered to an adhering surface 111A of the skirt 110 and configured to generate an output in accordance with a degree of deformation of the adhering surface 111A, and a control unit 18 configured to control the liquid discharging unit 100 and/or the transport unit 9 on the basis of the output of the piezoelectric film sensor 120. In addition, a slit may be formed around a periphery of the adhering surface 111A of the skirt 110. The recording apparatus 1 will be described in detail below.

As illustrated in FIG. 1, the recording apparatus 1 of the exemplary embodiment transports the recording medium P in the transport direction A from a setting unit 14 of the recording medium P to a winding unit 15 of the recording medium P via a platen 2, a platen 3, and a platen 4 serving as support units of the recording medium P. That is, the area from the setting unit 14 to the winding unit 15 serves as a transport path of the recording medium P of the recording apparatus 1, and the platen 2, the platen 3, and the platen 4 serve as support units of the recording medium P provided to the transport path. Note that the setting unit 14 rotates in a rotation direction C to feed the recording medium P, and the winding unit 15 rotates in the rotation direction C to wind the recording medium P.

Note that while the recording apparatus 1 of the exemplary embodiment is configured to allow recording on the recording medium P that has a roll shape, the recording apparatus 1 is not limited to such a configuration and may allow recording on a recording medium P that has a cut-sheet shape. When the configuration allows recording on the recording medium P that has a cut-sheet shape, a so-called paper feed (feeding) tray and a paper feed (feeding) cassette or the like, for example, may be used as the setting unit 14 of the recording medium P. Further, a so-called discharge receiving unit, a paper discharge (discharge) tray, and a paper discharge (discharge) cassette, or the like, for example, may be used as a collecting unit other than the winding unit 15 of the recording medium P when discharging the recording medium P that has a cut-sheet shape.

Note that, in the exemplary embodiment, the wound roll-type recording medium P is used with a recording surface 16 on the outside. Thus, a rotating shaft of the setting unit 14 rotates in the rotation direction C when the recording medium P is fed from the setting unit 14. On the other hand, when the wound roll-type recording medium P is used with the recording surface 16 on the inside, the rotating shaft of the setting unit 14 can rotate in the direction opposite to the rotation direction C to feed the recording medium P.

Similarly, the winding unit 15 of the exemplary embodiment winds the recording medium P with the recording surface 16 on the outside, and thus the rotating shaft of the winding unit 15 rotates in the rotation direction C. On the other hand, when the recording medium P is used with the recording surface 16 on the inside, the rotating shaft of the winding unit 15 can rotate in the direction opposite to the rotation direction C to wind the recording medium P.

The platen 2 of the recording apparatus 1 of the exemplary embodiment is provided with a heater 6. The heater 6 is provided to heat (so-called preheat) the recording medium P before recording is executed by a recording head 12 serving as a recording unit.

Note that the recording apparatus 1 of the exemplary embodiment is configured to preheat the recording medium P from a surface 17 side opposite to the recording surface 16 of the recording medium P using the heater 6. Nevertheless, the recording apparatus 1 may, for example, be configured to preheat the recording medium P from the recording surface 16 side using a heater capable of heating the recording medium P. For example, a heater may irradiate infrared rays from the recording surface 16 side of the recording medium P to heat the recording medium P from the recording surface 16 side.

Further, the recording apparatus 1 of the exemplary embodiment is provided with a driving roller 5 between the platen 2 and the platen 3. This driving roller 5 includes a rotating shaft arranged in an intersecting direction B that intersects with the transport direction A. The driving roller 5 applies a feeding force to the surface 17 of the recording medium P.

Further, a driven roller 7 that includes a rotating shaft in the intersecting direction B is provided to or at a position facing the driving roller 5. The recording medium P can be interposed between or pinched by the driving roller 5 and the driven roller 7, which form a pair of rollers. With such a configuration, the transport unit 9 is provided between or by the driving roller 5 and the driven roller 7. Here, the driven roller refers to a roller that rotates in association with the transport of the recording medium P.

Further, when the recording medium P is transported in the transport direction A, the driving roller 5 rotates in the rotation direction C, and the driven roller 7 rotates in the direction opposite to the rotation direction C.

Further, the liquid discharging unit 100 is a section or portion configured to discharge ink (or other liquid) onto the recording medium P. The liquid discharging unit 100 includes the recording head 12, a carriage 11, and the like. The recording head 12 is provided on a surface facing the platen 3 of the carriage 11. The recording apparatus 1 discharges ink from a nozzle forming surface (surface formed by a plurality of nozzles that discharge the ink) F of the recording head 12 in a direction D (in the direction from a nozzle forming surface F to the recording medium P; vertically downward in the exemplary embodiment) while the recording head 12 is reciprocated in the intersecting direction B via the carriage 11, and forms a desired image. The region where the ink is discharged onto the recording medium P on the platen 3 is equivalent to the "recording region". According to such a configuration, the recording head 12 can discharge ink serving as the liquid onto the recording medium P.

Note that while the recording apparatus 1 of the exemplary embodiment includes the recording head 12 that records while reciprocating, the recording apparatus 1 may include a so-called line head provided with a plurality of nozzles configured to discharge ink in the intersecting direction B that intersects with the transport direction A. When the recording apparatus 1 includes the line head, the line head is equivalent to the "liquid discharging unit".

In one example, the "line head" is a recording head in which the region of the nozzles formed in the intersecting direction B that intersects with the transport direction A of the recording medium P is capable of covering the recording medium P across the entire intersecting direction B or across a region wider than the recording medium in one example, and is used in a recording apparatus that forms an image by relatively moving the recording head or the recording medium P. Note that the region of the nozzles of the line head in the intersecting direction B need not be capable of covering the entire recording medium P supported by the recording apparatus across the entire intersecting direction B.

Further, both side end portions of the carriage 11 in the intersecting direction B are provided with a skirt 110 onto which the piezoelectric film sensor 120 (refer to FIG. 2 and FIG. 3) is adhered in one example. The skirt 110 is a member configured to suppress contact between the recording medium P and the recording head 12. The specific configuration of the piezoelectric film sensor 120 and the skirt 110 will be described later.

Further, a heater 8 is provided on a downstream side of the recording head 12 in the transport direction A (refer to FIG. 1) in one embodiment. This heater 8 serves as a heating unit capable of irradiating infrared rays toward the region recorded by the recording head 12.

Note that, while the heater 8 of the exemplary embodiment is an infrared ray heater provided to or at a position facing the platen 3 and capable of heating the recording surface 16 side of the recording medium P, the heater 8 is not limited to such a heater, and a heater capable of heating the recording medium P from the platen 3 side (surface 17 side) may be used.

Further, a heater 13 capable of irradiating infrared rays is provided on the downstream side of the heater 8 in the transport direction A of the recording medium P. Note that, while the heater 13 of the exemplary embodiment is an infrared ray heater provided to a position facing the platen 4 and capable of heating the recording surface 16 side of the recording medium P, the heater 13 is not limited to such a heater. A heater capable of heating the recording medium P from the platen 4 side (surface 17 side) may be used. Further, a blowing device such as a fan or the like may be used in place of a heating apparatus such as the infrared ray heater, for example.

Next, a basic configuration of the piezoelectric film sensor 120 and the skirt 110, which are the main parts of the recording apparatus 1 of the exemplary embodiment, will be described.

Figure 2:
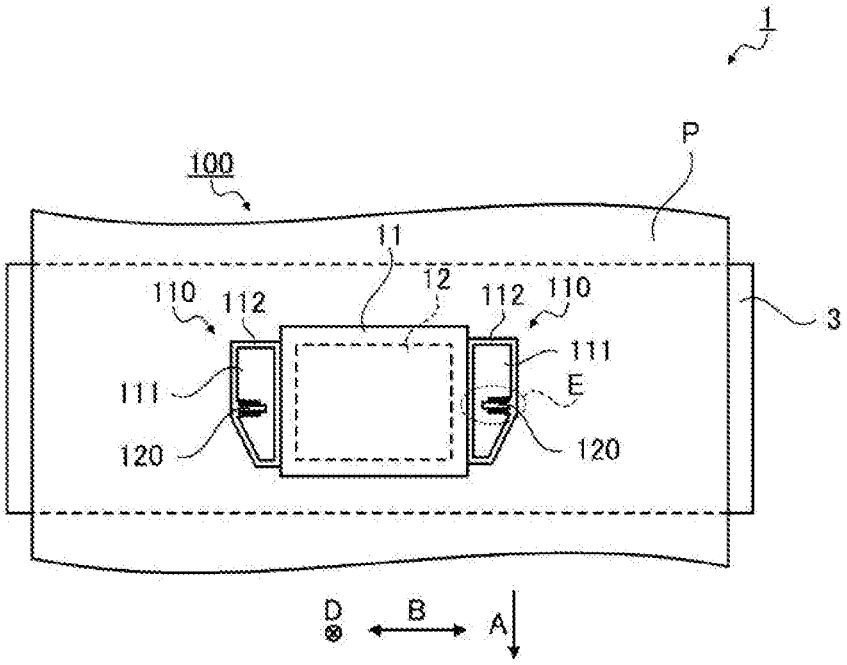
FIG. 2 is a schematic plan view illustrating a main part of the recording apparatus according to Example 1 of the invention.
Figure 3:
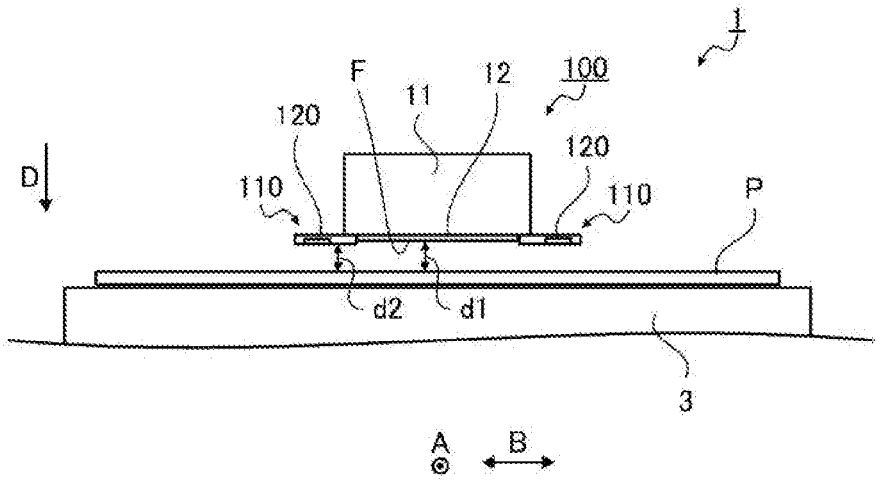
FIG. 3 is a schematic front cross-sectional view illustrating the main part of the recording apparatus according to Example 1 of the invention.

FIG. 2 is a schematic plan view illustrating the liquid discharging unit 100 of the exemplary embodiment, and FIG. 3 is a schematic front cross-sectional view illustrating the liquid discharging unit 100.

The liquid discharging unit 100 of the exemplary embodiment, as illustrated in FIG. 2 and FIG. 3, is provided with the skirt 110. The piezoelectric film sensor 120 is adhered to the skirt 110, on both side end portions of the carriage 11 in the intersecting direction B. The skirts 110, as illustrated in FIG. 3, are each configured to ensure that a space d2 between the recording medium P and a bottom surface of the skirt 110 (back surface of the surface onto which the piezoelectric film sensor 120 is adhered) is smaller than a space d1 between the recording medium P and the recording head 12 (nozzle forming surface F).

As described above, the recording apparatus 1 of the exemplary embodiment includes the carriage 11, which includes the recording head 12 configured to discharge ink onto the recording medium P, and the transport unit 9 configured to transport the recording medium P. Further, as illustrated in FIG. 2 and FIG. 3, the piezoelectric film sensors 120 are adhered to the skirts 110 provided to or on both side end portions of the carriage 11 in the intersecting direction B. This arrangement makes it possible to detect slight distortion of the skirts 110. That is, the recording apparatus 1 of the exemplary embodiment can detect contact between the recording medium P and the carriage 11 with high accuracy (an accuracy corresponding to the slight distortion) by detecting this slight distortion. Because the slight distortions can be detected, it is possible to suppress contact between the recording medium P and the carriage 11, which may cause damage to at least one of the recording medium P and the carriage 11 (in particular, this may cause damage to the recording head 12).

Further, when the recording apparatus 1 of the exemplary embodiment detects displacement (deformation) of the piezoelectric film sensor 120, the recording apparatus 1 can stop at least one of the discharging of ink by the recording head 12 provided to the carriage 11 and the transport of the recording medium P by the transport unit 9 by control performed by the control unit 18 (refer to FIG. 4) described later. In other words, transport of the medium may be stopped or slowed and/or the ejection of liquid may be stopped when the displacement or deformation is detected. This may allow the problem to be identified and remedied before continuing with the printing operation.

In one example, the piezoelectric film sensor 120 is a sensor configured by arranging a piezoelectric element into a film shape. The piezoelectric film sensor is a highly accurate sensor capable of detecting a slight distortion of the section on which the piezoelectric film sensor 120 is attached as displacement. That is, the recording apparatus 1 of the exemplary embodiment can detect contact between the recording medium P and the liquid discharging unit 100 (or contact between the recording medium P and the piezoelectric film sensor or skirt) with high accuracy. The accuracy corresponds to the slight distortion of the section on which the piezoelectric film sensor 120 is attached. Then, when contact between the recording medium P and the liquid discharging unit 100 (or more specifically the skirt 110 or the sensor) is detected, the damage to at least one of the recording medium P and the liquid discharging unit 100 is suppressed. This makes it possible to stop at least one of the discharging of ink by the recording head 12 of the liquid discharging unit 100 and the transport of the recording medium P by the transport unit 9 by the control performed by the control unit 18. As a result, the recording apparatus 1 of the exemplary embodiment can suppress contact between the recording medium P and the liquid discharging unit 100 which causes damage to at least one of the recording medium P and the liquid discharging unit 100.

Note that the ink discharging operation stopped by the control performed by the control unit 18 may include the movement operation of the carriage 11 in the intersecting direction B. Thus, control may be performed to stop the ejection of ink and/or to stop movement of the carriage 11.

Further, as described above, in the recording apparatus 1 of the exemplary embodiment, the carriage 11 (recording head 12) is capable of discharging ink while reciprocating in the intersecting direction B that intersects with the transport direction A of the recording medium P. Then, with the control performed by the control unit 18, it is possible to enable detection of a displacement of the piezoelectric film sensor 120 during at least a constant velocity movement time during reciprocation of the carriage 11.

The reciprocation of the carriage 11 includes an acceleration movement time in which the carriage 11 accelerates from a stop state to a constant velocity state, the constant velocity movement time, and a deceleration movement time in which movement decelerates from a constant velocity state to a stop state. During the acceleration movement time and the deceleration movement time, a force in the reciprocation direction is applied to the carriage 11 and may possibly cause deformation (distortion) of the carriage 11. This leads to the concern that, during the acceleration movement time and the deceleration movement time of the carriage 11, deformation of the carriage 11 associated with the acceleration or the deceleration may be misjudged as deformation of the carriage 11 associated with contact between the recording medium P and the carriage 11. Nevertheless, in the recording apparatus 1 of the exemplary embodiment, the carriage 11 is capable of discharging ink while reciprocating in the intersecting direction B that intersects with the transport direction A of the recording medium P, and detection of a displacement of the piezoelectric film sensor 120 is enabled only during the constant velocity movement time during reciprocation of the carriage 11 in one example. As a result, the configuration makes it possible to suppress the misjudgment that the recording medium has come into contact with the sensor or with the carriage or with the recording head, or the like.

Note that in the exemplary embodiment, while a configuration in which "detection of displacement of the piezoelectric film sensor 120 is enabled only during the constant velocity movement time of reciprocation of the carriage 11" is a configuration in which detection is stopped during the acceleration movement time as well as the deceleration movement time of the carriage 11, the configuration may allow detection during the acceleration movement time and the deceleration movement time of the carriage 11 using a standard different from the constant velocity movement time (for example, by increasing a threshold of the acceleration movement time and the deceleration movement time). More specifically, the threshold displacement detected during the acceleration movement time and the deceleration movement time may be different (e.g., greater) than the threshold displacement detected for the constant velocity movement time.

Further, as illustrated in FIG. 2 and FIG. 3, in the liquid discharging unit 100 of the exemplary embodiment, the piezoelectric film sensor 120 is provided on both sides in the intersecting direction B, which is the direction of reciprocation, of the position of the recording head 12, which serves as the discharging position of the ink of the carriage 11. Thus, the piezoelectric film sensor 120 may be disposed on both sides of the carriage 11 with respect to the direction B. Thus, when the carriage 11 moves in both directions during reciprocation, the configuration allows detection of contact between the recording medium P and the liquid discharging unit 100 with high accuracy (an accuracy corresponding to the slight distortion of the section on which the piezoelectric film sensor 120 is attached).

Further, the recording apparatus 1 of the exemplary embodiment is configured to determine displacement of the piezoelectric film sensor 120 by the control unit 18 using a plurality of standards, making it possible to change the method in which at least one of the discharging of ink by the liquid discharging unit 100 and the transport of the recording medium P by the transport unit 9 is stopped in accordance with the size of the displacement. The control unit 18 can determine the displacement in multiple ways. That is, the configuration allows the liquid discharging operation to be stopped by different methods in accordance with the degree of contact between the recording medium P and the liquid discharging unit 100.

Specifically, the recording apparatus 1 of the exemplary embodiment may have two threshold values that determine displacement of the piezoelectric film sensor 120. Then, when displacement greater than or equal to a first threshold value and less than a second threshold value is detected, the carriage 11 is moved to a home position (a position that allows the recording head 12 to be capped by a cap (not illustrated)). Then, reciprocation of the carriage 11 is stopped. Further, when displacement greater than or equal to the second threshold value is detected, reciprocation of the carriage 11 is stopped immediately. Thus, the recording apparatus 1 of the exemplary embodiment is capable of waiting for favorable timing (e.g., after a main pass of the recording head for example) to stop the liquid discharging operation when the degree of contact between the recording medium P and the carriage 11 is low, and immediately stopping the liquid discharging operation when the degree of contact between the recording medium P and the carriage 11 is high. The decision is made on the basis of the control performed by the control unit 18. The control unit 18 may monitor the output of the piezoelectric film sensor continuously or periodically (may be a very fast period such that the output is sampled multiple times during each pass of the recording head).

Next, the electrical configuration of the recording apparatus 1 of the exemplary embodiment will be described.

Figure 4:
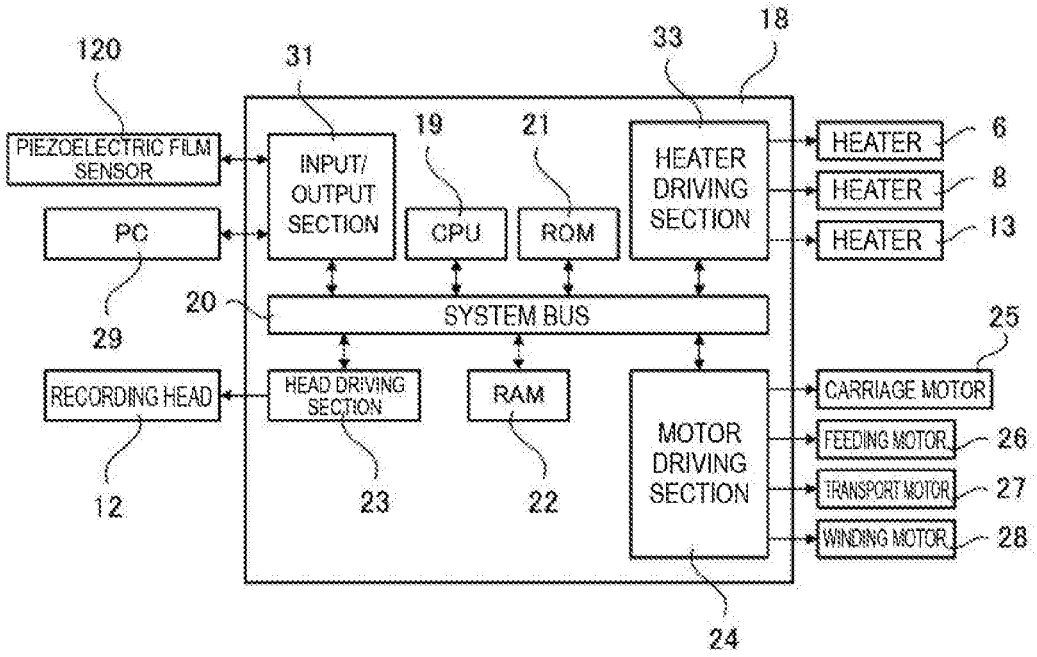
FIG. 4 is a block diagram illustrating the recording apparatus according to Example 1 of the invention.

FIG. 4 is a block diagram of the recording apparatus 1 of the exemplary embodiment.

The control unit 18 is provided with a CPU 19 that carries out overall control of the recording apparatus 1. The CPU 19 is connected with or to a ROM 21 that stores various control programs and the like that are executed by the CPU 19, and a RAM 22 capable of temporarily storing data, via a system bus 20.

Further, the CPU 19 is connected with a head driving unit 23 configured to drive the recording head 12, via the system bus 20.

Further, the CPU 19 is connected with a motor driving unit 24 configured to drive a carriage motor 25 configured to move the carriage 11, a feeding motor 26 that serves as the driving source of the setting unit 14, a transport motor 27 that serves as the driving source of the driving roller 5, and a winding motor 28 that serves as the driving source of the winding unit 15, via the system bus 20.

Further, the CPU 19 is connected with a heater driving unit 33 configured to drive the heaters 6, 8, 13 via the system bus 20.

Furthermore, the CPU 19 is connected with an input/output unit 31 via the system bus 20, and the input/output unit 31 is connected with the piezoelectric film sensors 120 and a PC 29 which serves as an external device that inputs record data and the like into the recording apparatus 1.

Next, a specific configuration example of the skirt 110 serving as the "sensor adhering plate" will be described.

Figure 5:
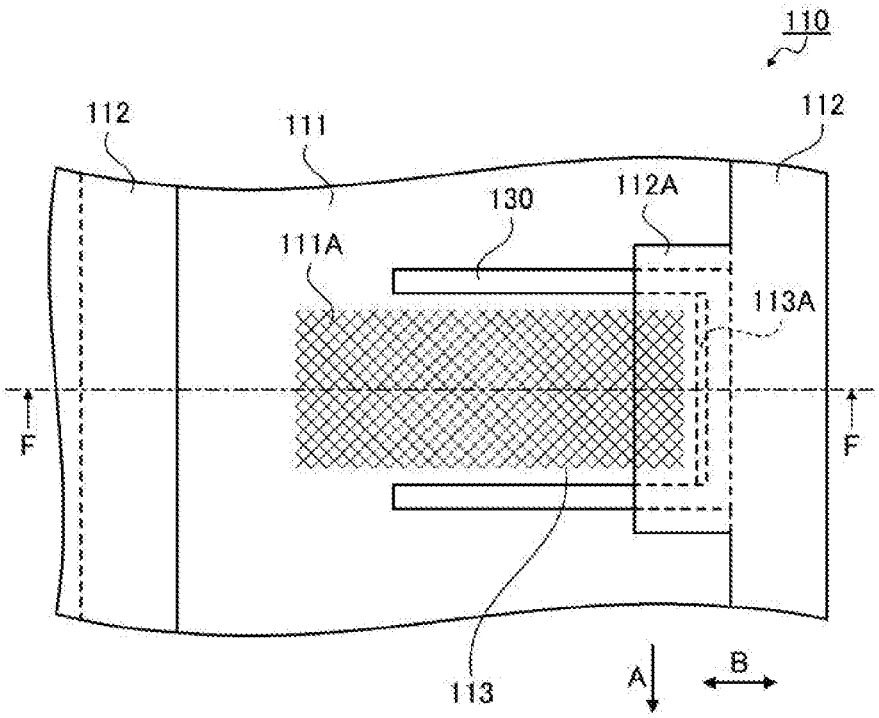
FIG. 5 is a plan view illustrating a main part E of a skirt illustrated in FIG. 2.
Figure 6:
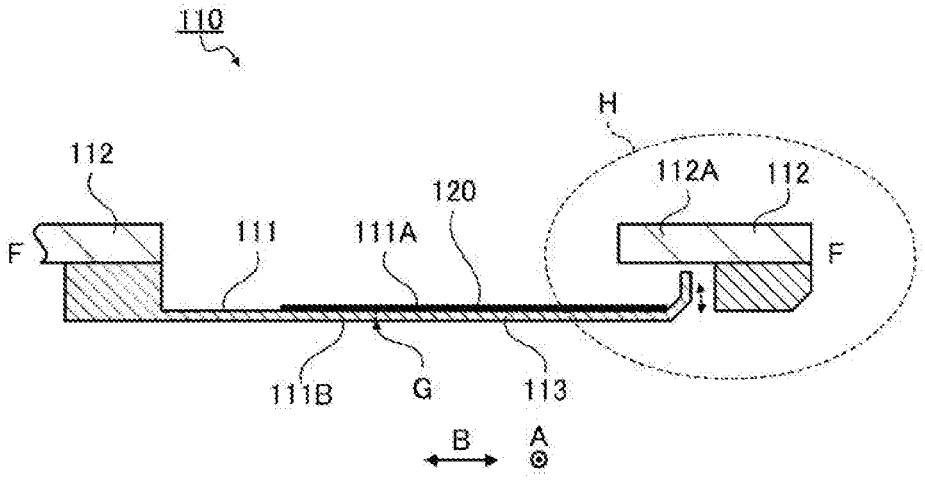
FIG. 6 is a cross-sectional view along F-F in FIG. 5.

FIG. 5 is a plan view illustrating a main part E of the skirt 110 illustrated in FIG. 2. FIG. 6 is a cross-sectional view along F-F in FIG. 5.

The skirt 110 is a plate-like body provided to or on the liquid discharging unit 100 in a position that faces (opposes) the recording medium P transported to the recording region. The skirt 110 includes a resin plate 111, a frame 112, and the like.

The resin plate 111, as illustrated in FIG. 2, has a position and a length in the transport direction A (length in the longitudinal direction of the resin plate 111) when attached to the carriage 11 that cover the movement range of the recording head 12. That is, the length of the resin plate 111 in the transport direction A is the same as or somewhat greater than the length of the recording head 12 in the transport direction A. When, in a planer view, the carriage 11 is moved in the intersecting direction B, the movement range of the carriage 11 enters the range in which the resin plate 111 moves.

The length of the resin plate 111 in the intersecting direction B is longer than a maximum length of the piezoelectric film sensor 120, and short to the extent that the length of the recording apparatus 1 in the intersecting direction B is not needlessly long when the carriage 11 is moved in the intersecting direction B. That is, the length of the resin plate 111 in the intersecting direction B is acceptable as long as the length is a necessary and sufficient length for provision of the adhering surface 111A which allows adherence of the piezoelectric film sensor 120 with the longitudinal direction thereof in the intersecting direction B.

Further, one corner portion of the resin plate 111 on the transport direction A side (corner portion on the side opposite to the side along the carriage 11) has an obliquely cut shape. When the carriage 11 is moved in the intersecting direction B, for example, and a wrinkle or a floating section that occurred in the recording medium P comes into contact with this corner portion of the resin plate 111, the obliquely cut shape makes it possible to press the wrinkle of the recording medium P in the transport direction A. In this example, a width of the resin plate 111 narrows along at least a portion of its length in the transport direction. The narrowest portion of the resin plate 111 and of the sensor 120 is furthest downstream in the transport direction.

A frame 112 may be a metal frame provided to increase a rigidity of the skirt 110 and, as illustrated in FIG. 2 and FIG. 6, may be screw-fastened or the like from an upper side (the side opposite to the side opposing the recording medium P) of an outer edge portion of the resin plate 111, thereby supporting the resin plate 111. Further, the frame 112 is fixed to the carriage 11 by screw-fastening or the like. Note that the frame 112 may be configured integrally with the frame that constitutes the carriage 11 rather than as a separate body fixed to the carriage 11.

In the substantial center portion of the resin plate 111, the adhering surface 111A onto which the piezoelectric film sensor 120 is adhered is provided in a rectangular shape, by way of example, on a back surface of a recording medium facing surface 111B (refer to FIG. 6) that faces the recording medium P transported to the recording region, as illustrated in FIG. 5. Further, the space d2 (refer to FIG. 3) between the recording medium facing surface 111B (back surface of the adhering surface 111A) and the recording medium P is smaller than the space d1 between the recording head 12 and the recording medium P.

Further, a slit 130 is formed around the periphery of the adhering surface 111A (or around a portion of the periphery of the adhering surface 111A), forming a cantilever (hereinafter referred to as a "detection beam 113") in which the resin plate 111 that supports the adhering surface 111A extends in the intersecting direction B. Specifically, the slit 130 (a fine groove that penetrates the resin plate 111 of the skirt 110) is formed along three sides (the two sides of the upstream side and the downstream side in the transport direction A (excluding a portion near the carriage 11) and the side opposite to the carriage 11) of the periphery of the rectangular region where the piezoelectric film sensor 120 is adhered. With the slit 130 thus provided, the cantilever-shaped region (detection beam 113) with the end portion vicinity of the slit 130 near the carriage 11 (the vicinity of the position G illustrated in FIG. 6) formed as a fulcrum is configured to be flexible while the resin plate 111 at large is supported with high rigidity by the frame 112. The cantilever-shaped region is thus free to move and deform. By detecting the displacement of any deformation, the control unit can determine how to respond to any detected deformation as disclosed herein.

Figure 7:
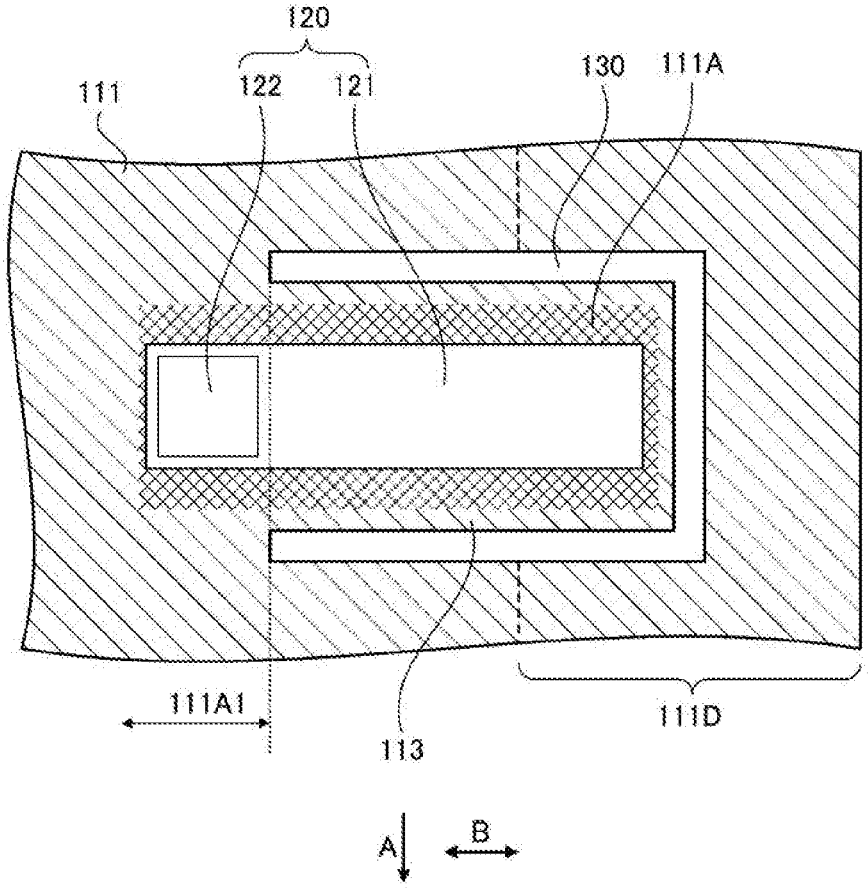
FIG. 7 is a schematic plan view illustrating a piezoelectric film sensor adhered to an adhering surface.

FIG. 7 is a schematic plan view illustrating the piezoelectric film sensor 120 adhered to the adhering surface 111A. Note that, in FIG. 7, the illustration of the frame 112 is omitted.

The piezoelectric film sensor 120 includes a detecting unit 121 configured to generate an output in accordance with the degree of deformation of the adhering surface 111A (that is, the detection beam 113) onto which the piezoelectric film sensor 120 is adhered. The sensor 120 also includes a circuit unit 122 that includes a circuit configured to transmit the output to the control unit 18. As illustrated in FIG. 7, of the piezoelectric film sensor 120, the circuit unit 122 is adhered in a position that enters a region 111A1 near the carriage 11 from a line that connects the end portions of the slit 130 near the carriage 11, and the detecting unit 121 is adhered in the region (the detection beam 113) that extends to the side opposite to the carriage 11. In other words, the slit 130 is formed around the periphery of the adhering surface 111A where the detecting unit 121 is adhered, and is not formed around the periphery of the adhering surface 111A where the circuit unit 122 is adhered. Thus, the slit 130 is arranged to minimize deformations to the circuit unit 122. Rather, the slit 130 effectively defines the detection beam that is subject to deformation and whose deformation is detected by the circuit unit 122 and output to the control unit 18.

Figure 8:
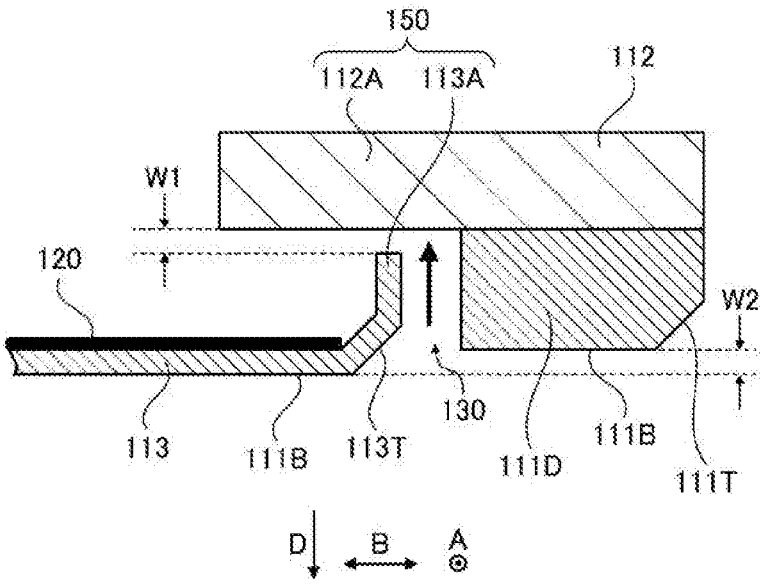
FIG. 8 is a schematic front cross-sectional view illustrating a main part H of the skirt illustrated in FIG. 6.

FIG. 8 is a schematic front cross-sectional view illustrating a main part H of the skirt 110 illustrating in FIG. 6.

As described above, while the detection beam 113, due to the slit 130, is configured to be easily flexible as a cantilever, the end portion vicinity on the carriage 11 side of the slit 130 serves as a support unit. Thus, the skirt 110 is configured to regulate deformation of the detection beam 113. That is, when the recording medium P comes into contact with the recording medium facing surface 111B of the detection beam 113 and presses the recording medium facing surface 111B upward in the direction of the arrow illustrated in FIG. 8, the skirt 110 regulates the deformation of the detection beam 113 caused by this upward pressing. Specifically, as described below, the skirt 110 includes a deformation regulating unit 150 that regulates the maximum amount of deformation of the adhering surface 111A. This may prevent damage to the adhering surface 111A in one example.

The deformation regulating unit 150 includes a contact unit 113A, a receiving unit 112A, a guard unit 111D, and the like.

The contact unit 113A, as illustrated in FIG. 5 and FIG. 8, is configured as a plate-like body that protrudes from the detection beam 113 in the direction opposite to the direction D. The contact unit 113A protrudes at the tip end portion (end portion on the side opposite to the carriage 11) of the detection beam 113. Thus, the detection beam 113 has an upturned portion at the tip that extends away from the recording medium P.

The receiving unit 112A, as illustrated in FIG. 5 and FIG. 8, is integrally configured with the frame 112 as a plate-like body that extends from the frame 112 in the direction of the carriage 11 to an upper side (side in the direction opposite to the direction D) of the contact unit 113A.

The guard unit 111D, as illustrated in FIG. 7, is a region within the resin plate 111 positioned in a direction away from the carriage 11, and encompasses substantially one-third of the tip end side of the detection beam 113 and, as illustrated in FIG. 8, is configured to be in a direction by which a height position (position in the direction D) of the recording medium facing surface 111B is separated from the recording medium P by W2 (that is, the resin plate 111 is decreased in thickness by the thickness W2 at least in the guard unit 111D portion of the resin plate 111). In this example, the guard unit 111D is further away from the recording medium P than the detection beam in a direction of the arrow D.

In a state without an external force applied to the detection beam 113, the detection beam 113 does not flex and, as illustrated in FIG. 8, a space W1 exists between a tip end of the contact unit 113A and a lower end surface (surface on the direction D side) of the receiving unit 112A. That is, when the recording medium P comes into contact with the recording medium facing surface 111B of the detection beam 113 and the recording medium facing surface 111B is pressed upward in the direction of the arrow illustrated in FIG. 8, the tip end (contact unit 113A) of the detection beam 113 moves by an amount equivalent to the space W1. However, because the tip end of the contact unit 113A comes into contact with the lower end surface of the receiving unit 112A, any further movement is regulated.

Further, in a state without an external force applied to the detection beam 113, the guard unit 111D is configured to ensure a height difference of W2 in the direction D between the recording medium facing surface 111B of the guard unit 111D and the recording medium facing surface 111B of the detection beam 113, as illustrated in FIG. 8.

Note that, in the exemplary embodiment, W1=W2. Accordingly, even if the tip end of the contact unit 113A comes into contact with the lower end surface of the receiving unit 112A and a force is applied that works to press the detection beam 113 further upward, the detection beam 113 is guarded by the guard unit 111D supported by the frame 112 having high rigidity, thereby suppressing deformation of the detection beam 113.

Note that the contact unit 113A may include a tapered portion 113T that does not protrude straight from the tip end portion (the end portion on the side opposite to the carriage 11) of the detection beam 113 in the direction opposite to the direction D, but rather gradually comes closer to the receiving unit 112A as the distance from the carriage 11 increases, as illustrated in FIG. 8. When an end portion of the recording medium P or a peak portion of a wrinkle of the recording medium P floats upward from the platen 3 (refer to FIG. 1) and comes into contact with the tapered portion 113T (comes into contact from the right side with the tapered portion 113T, which moves leftward, when FIG. 8 is viewed from the front), this tapered portion 113T makes it possible to press the recording medium P in the direction of direction D. Further, as illustrated in FIG. 8, a tapered portion 111T is also provided to the guard unit 111D to achieve this same advantage.

While one (the right side when FIG. 2 is viewed from the front) of the skirts 110 provided to both side end portions of the carriage 11 in the intersecting direction B has been described using FIG. 5 to FIG. 8, the other skirt 110 is similarly configured, with the left and right in the drawings reversed.

As described above, according to the liquid discharging apparatus (the recording apparatus 1) of the exemplary embodiment, it is possible to achieve the advantages below.

The slit 130 (a fine groove that penetrates the skirt 110 or that penetrates the resin plate 111) is formed around the periphery or a portion of the periphery of the adhering surface 111A onto which the piezoelectric film sensor 120 is adhered. This makes the region of the skirt 110 (resin plate 111) that includes the adhering surface 111A less susceptible to stress from the periphery when the adhering surface 111A deforms (or is about to deform). That is, the slit 130 is provided around the periphery of the adhering surface 111A, making it possible to facilitate deformation of the adhering surface 111A. Thus, the piezoelectric film sensor 120 adhered to the adhering surface 111A makes it possible to detect the recording medium P that comes into contact with the region of the skirt 110 that includes the adhering surface 111A, with higher sensitivity. This makes it possible to further enhance the detection accuracy of the contact state when the recording medium P and the liquid discharging unit 100 come into contact, and suppress contact between the recording medium P and the liquid discharging unit 100 which causes damage to at least one of the recording medium P and the liquid discharging unit 100.

Further, the skirt 110 includes the deformation regulating unit 150 that regulates the maximum amount of deformation of the adhering surface 111A, thereby preventing the adhering surface 111A, which is configured to easily deform, from deforming beyond a limit. That is, damage to the skirt 110 (the region of the skirt 110 that includes the adhering surface 111A, that is, the detection beam 113) as a result of contact with the recording medium P or the like is prevented.

Further, the distance (space d2) between the back surface (recording medium facing surface 111B) of the adhering surface 111A onto which the piezoelectric film sensor 120 is adhered and the recording medium P transported to the recording region is less than the distance (space d1) between the recording head 12 and the recording medium P transported to the recording region. This makes it possible for the piezoelectric film sensor 120 to detect that the recording medium P near but not in contact with the recording head 12. This makes it possible to suppress contact between the recording medium P and the liquid discharging unit 100 which causes damage to at least one of the recording medium P and the liquid discharging unit 100.

Further, the slit 130 is provided around the periphery (or a portion thereof) of the adhering surface 111A onto which the detecting unit 121 of the piezoelectric film sensor 120 is adhered, that is, the detection beam 113 is provided. This makes it possible to facilitate deformation of the adhering surface 111A onto which the detecting unit 121 is adhered. This makes it possible to further increase the sensitivity of the piezoelectric film sensor 120. Further, the slit 130 is not formed around the periphery of the adhering surface 111A onto which the circuit unit 122 is adhered, making it possible to decrease the degree to which the circuit unit 122 deforms and thus suppress a decrease in reliability of the circuit unit 122. Thus, the slit 130 is formed to facilitate deformation of the detection beam while ensuring the rigidity of the circuit unit 122. This increases the reliability of the sensor 120.

Further, the liquid discharging unit 100 is capable of discharging liquid (ink) while moving in the intersecting direction B that intersects with the transport direction A, and the control unit 18 controls the movement of the liquid discharging unit 100 on the basis of the output of the piezoelectric film sensor 120. This makes it possible to suppress contact between the liquid discharging unit 100 that moves in the intersecting direction B and the recording medium P which causes damage to at least one of the recording medium P and the liquid discharging unit 100.

Note that the invention is not limited to the exemplary embodiment described above, and various changes and modifications may be applied thereto. Modified examples are described below. Here, the components that are the same as those in the exemplary embodiment described above are referenced using like numbers, and duplicate descriptions thereof are omitted.

Modified Example 1

Figure 9:
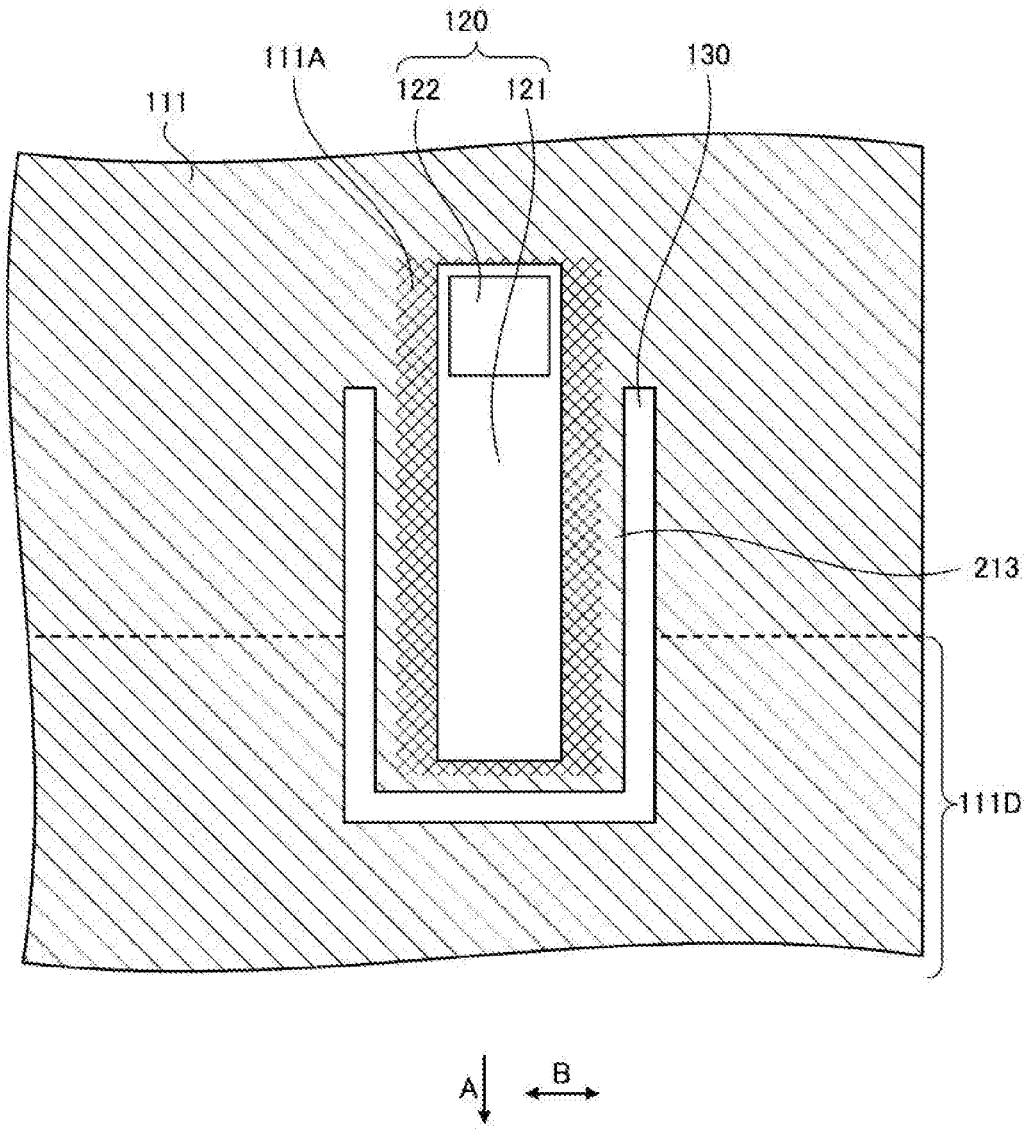
FIG. 9 is a schematic plan view illustrating the piezoelectric film sensor adhered to an adhering surface of the skirt according to Modified Example 1.

FIG. 9 is a schematic plan view illustrating the piezoelectric film sensor 120 adhered to the adhering surface 111A of the skirt 110 according to Modified Example 1.

While Exemplary Embodiment 1 describes the slit 130 as being formed around the periphery of the adhering surface 111A as a cantilever region (detection beam 113) in which the adhering surface 111A extends in the intersecting direction B as illustrated in FIG. 5 to FIG. 7, the slit 130 is not limited to this configuration. As illustrated in FIG. 9, the slit 130 may be formed around the periphery of the adhering surface 111A as a cantilever region (detection beam 213) in which the adhering surface 111A extends in the transport direction A. That is, the detection beam 113 described in Exemplary Embodiment 1 may be rotated 90 degrees rightward in FIG. 7. Further, the rotation angle is not limited to 90 degrees, and thus, for example, the detection beam 113 may be rotated 45 degrees rightward. In addition, it may be possible to include multiple sensors 120 in each skirt.

The disclosure of Japan Application No. 2016-107083 filed May 30, 2016 is incorporated by reference in its entirety.

What is claimed is:

1. A liquid discharging apparatus, comprising:

a transport unit configured to transport a recording medium in a transport direction;

a liquid discharging unit configured to discharge a liquid onto the recording medium transported to a recording region;

a sensor adhering plate provided to the liquid discharging unit in a position facing the recording medium transported to the recording region;

a piezoelectric film sensor adhered to an adhering surface of the sensor adhering plate and configured to generate an output in accordance with a degree of deformation of the adhering surface; and a control unit configured to control the liquid discharging unit and/or the transport unit on the basis of the output of the piezoelectric film sensor;

the adhering surface of the sensor adhering plate including a slit formed around a periphery thereof.

2. The liquid discharging apparatus according to claim 1, wherein the sensor adhering plate includes a deformation regulating unit configured to regulate a maximum amount of deformation of the adhering surface.

3. The liquid discharging apparatus according to claim 1, wherein:

the liquid discharging unit includes a recording head provided with a plurality of nozzles configured to discharge the liquid;

the adhering surface is provided to or on a back surface of a recording medium facing surface of the sensor adhering plate, the recording medium facing surface facing the recording medium transported to the recording region; and a space between the back surface of the adhering surface and the recording medium transported to the recording region is smaller than a space between the recording head and the recording medium transported to the recording region.

4. The liquid discharging apparatus according to claim 1, wherein:

the piezoelectric film sensor includes a detecting unit configured to generate an output in accordance with the degree of deformation of the adhering surface, and a circuit unit that includes a circuit configured to transmit the output to the control unit; and the slit is formed around the periphery of the adhering surface onto which the detecting unit is adhered.

5. The liquid discharging apparatus according to claim 1, wherein:

the liquid discharging unit allows discharging of the liquid while moving in an intersecting direction that intersects with the transport direction; and the control unit is configured to control the movement of the liquid discharging unit on the basis of the output of the piezoelectric film sensor.

6. The liquid discharging apparatus according to claim 2, wherein:

the liquid discharging unit includes a recording head provided with a plurality of nozzles configured to discharge the liquid;

the adhering surface is provided to or on a back surface of a recording medium facing surface of the sensor adhering plate, the recording medium facing surface facing the recording medium transported to the recording region; and a space between the back surface of the adhering surface and the recording medium transported to the recording region is smaller than a space between the recording head and the recording medium transported to the recording region.

7. The liquid discharging apparatus according to claim 2, wherein:

the piezoelectric film sensor includes a detecting unit configured to generate an output in accordance with the degree of deformation of the adhering surface, and a circuit unit that includes a circuit configured to transmit the output to the control unit; and the slit is formed around the periphery of the adhering surface onto which the detecting unit is adhered.

8. The liquid discharging apparatus according to claim 3, wherein:

the piezoelectric film sensor includes a detecting unit configured to generate an output in accordance with the degree of deformation of the adhering surface, and a circuit unit that includes a circuit configured to transmit the output to the control unit; and the slit is formed around the periphery of the adhering surface onto which the detecting unit is adhered.

9. The liquid discharging apparatus according to claim 2, wherein:

the liquid discharging unit allows discharging of the liquid while moving in an intersecting direction that intersects with the transport direction; and the control unit is configured to control the movement of the liquid discharging unit on the basis of the output of the piezoelectric film sensor.

10. The liquid discharging apparatus according to claim 3, wherein:

the liquid discharging unit allows discharging of the liquid while moving in an intersecting direction that intersects with the transport direction; and the control unit is configured to control the movement of the liquid discharging unit on the basis of the output of the piezoelectric film sensor.

11. The liquid discharging apparatus according to claim 4, wherein:

the liquid discharging unit allows discharging of the liquid while moving in an intersecting direction that intersects with the transport direction; and the control unit is configured to control the movement of the liquid discharging unit on the basis of the output of the piezoelectric film sensor.

12. The liquid discharging apparatus according to claim 1, wherein the output of the piezoelectric film sensor is compared to at least two threshold displacement values.

13. The liquid discharging apparatus according to claim 1, wherein the liquid discharging unit is stopped immediately if the output is greater than a second output, wherein the liquid discharging unit is allowed to finish a pass if the output is between the first and second thresholds.

* * * * *